US005943732A

United States Patent [19]

Bosyj et al.

[11] Patent Number: 5,943,732

[45] Date of Patent: Aug. 31, 1999

[54] DOOR VALVE FOR UTILITY VACUUM CLEANERS

[75] Inventors: Nick M. Bosyj; Donald R. Bowers, both of North Canton, Ohio; Nicholas Koukourakis, Lisle, Ill.; Conway Vincent, North Canton, Ohio; Richard A. Wareham, N. Canton, Ohio; Darwin S. Crouser, Canton, Ohio

[73] Assignee: The Hoover Company, North Canton, Ohio

[21] Appl. No.: 08/844,156

[22] Filed: Apr. 18, 1997

Related U.S. Application Data

[63] Continuation-in-part of application No. 08/182,655, Jan. 18, 1994, Pat. No. 5,644,815, which is a continuation of application No. 08/005,023, Jan. 15, 1993, abandoned.

[51] Int. Cl.[6] ..... A47L 9/00

[52] U.S. Cl. ..... 15/328; 15/352

[58] Field of Search ..... 15/328, 347, 327.1, 15/327.6, 352

[56] References Cited

U.S. PATENT DOCUMENTS

| | | | |
|---|---|---|---|
| 2,657,416 | 11/1953 | Smith | 15/331 |
| 3,029,461 | 4/1962 | Osborn | 15/328 X |
| 4,194,262 | 3/1980 | Finley et al. | 15/314 |
| 4,683,608 | 8/1987 | Berfield et al. | 15/328 |
| 4,841,595 | 6/1989 | Wiese | 15/352 |
| 4,951,346 | 8/1990 | Salmon | 15/322 |

*Primary Examiner*—Chris K. Moore

*Attorney, Agent, or Firm*—Renner, Kenner, Greive, Bobak, Taylor & Weber

[57] ABSTRACT

A unique valve door mechanism is disclosed for use in a dual chambered utility type vacuum cleaner having two suction inlets whereby the inactive suction inlet may be selectively closed and sealed off from the atmosphere. The valve door is slidingly suspended between guide rails whereby the door may be selectively positioned adjacent the suction inlet to be disabled. Atmospheric pressure is utilized to urge the valve door against the selected inlet opening thereby sealing off the inlet from the atmosphere. The valve may also be in the form of a rotatable, elbow-shaped body having a single plenum. The body may be rotated between at least two positions where the outlet to the plenum is in fluid communication with a wet tank in one position and a dry tank in the other position.

14 Claims, 13 Drawing Sheets

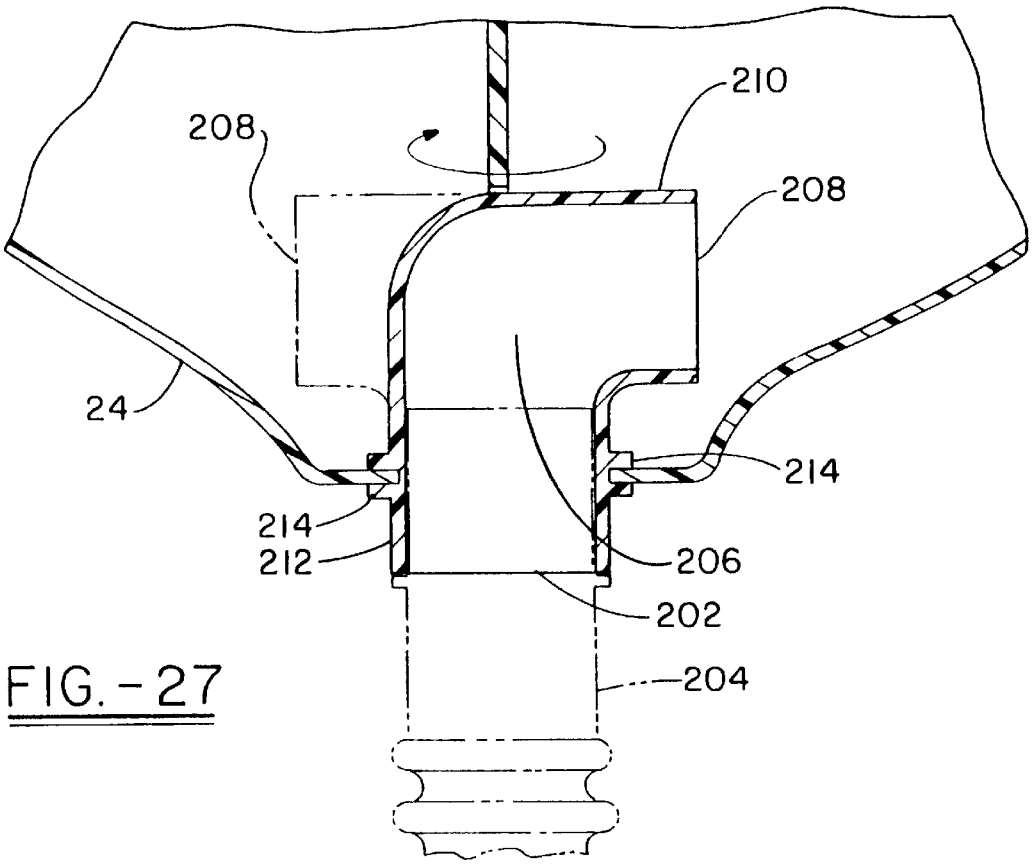
FIG.-27
FIG.-28
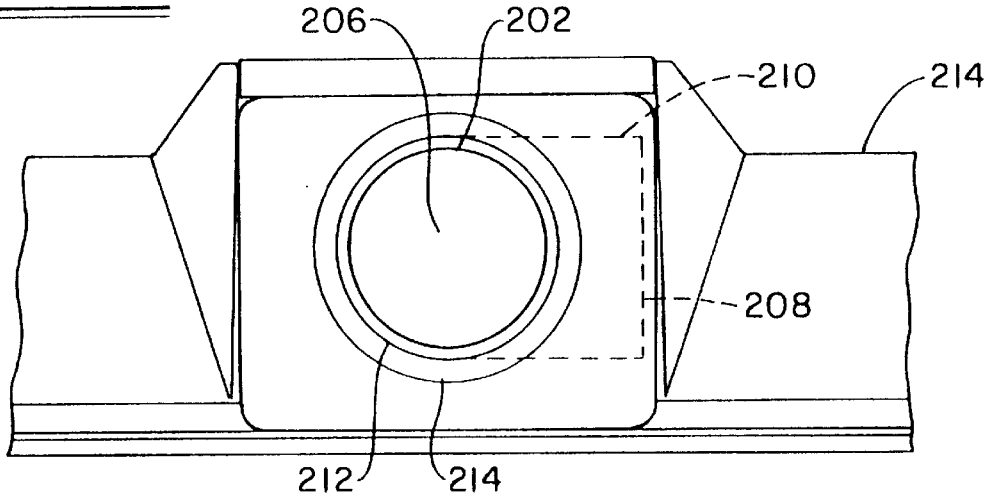

DOOR VALVE FOR UTILITY VACUUM CLEANERS

CROSS REFERENCE TO RELATED APPLICATIONS

This application is a continuation-in-part of application Ser. No. 08/182,655, filed Jan. 18, 1994, now U.S. Pat. No. 5,644,815 issued Jul. 8, 1997 which is a continuation of application Ser. No. 08/005,023, filed Jan. 15, 1993, now abandoned.

TECHNICAL FIELD

This invention relates to the art of vacuuming cleaners and more particularly to the art of dual chambered utility vacuum cleaners that have both wet and dry pickup chambers. Specifically, the present invention relates to the valve device that selectively directs debris into either the wet chamber or the dry chamber.

BACKGROUND OF THE INVENTION

The present invention generally relates to a dual chambered utility vacuum cleaner of the tank type typically used for alternating wet and dry pickup. In a dual chambered vacuum cleaner wherein one chamber or tank is used for wet debris, collection and the second for dry debris collection two separate and distinct suction inlets are necessary, one inlet communicating with the wet chamber and the other communicating with the dry chamber. Thus a simple and efficient valve mechanism is required to permit the operator to open the selected inlet and close the non selected inlet.

SUMMARY OF INVENTION

The herein disclosed invention teaches, as a preferred embodiment, a dual suction inlet utility vacuum cleaner wherein the inlets are positioned in a side by side relationship within the removable power head of the cleaner each opening to the atmosphere. A unique sliding door valve is supported between upper and lower guide rails such that the door may be slidingly and alternately positioned adjacent the selected suction inlet. The door mechanism permits transverse movement of the valve door, with respect to the guide rails, thereby permitting the valve door to be drawn up against the selected suction inlet by the force atmospheric pressure when the cleaner is activated thereby sealing off the selected suction inlet.

BRIEF DESCRIPTION OF THE DRAWINGS

FIG. 2A presents a partial elevational view of the valve door showing the valve door in the wet vacuuming mode.

FIG. 27 is a view similar to FIG. 23 showing another alternative valve door structure for use with a single vacuum inlet port.

FIG. 28 is a partial front elevational view showing the valve depicted in FIG. 27.

DESCRIPTION OF THE PREFERRED EMBODIMENT

Figure 1:
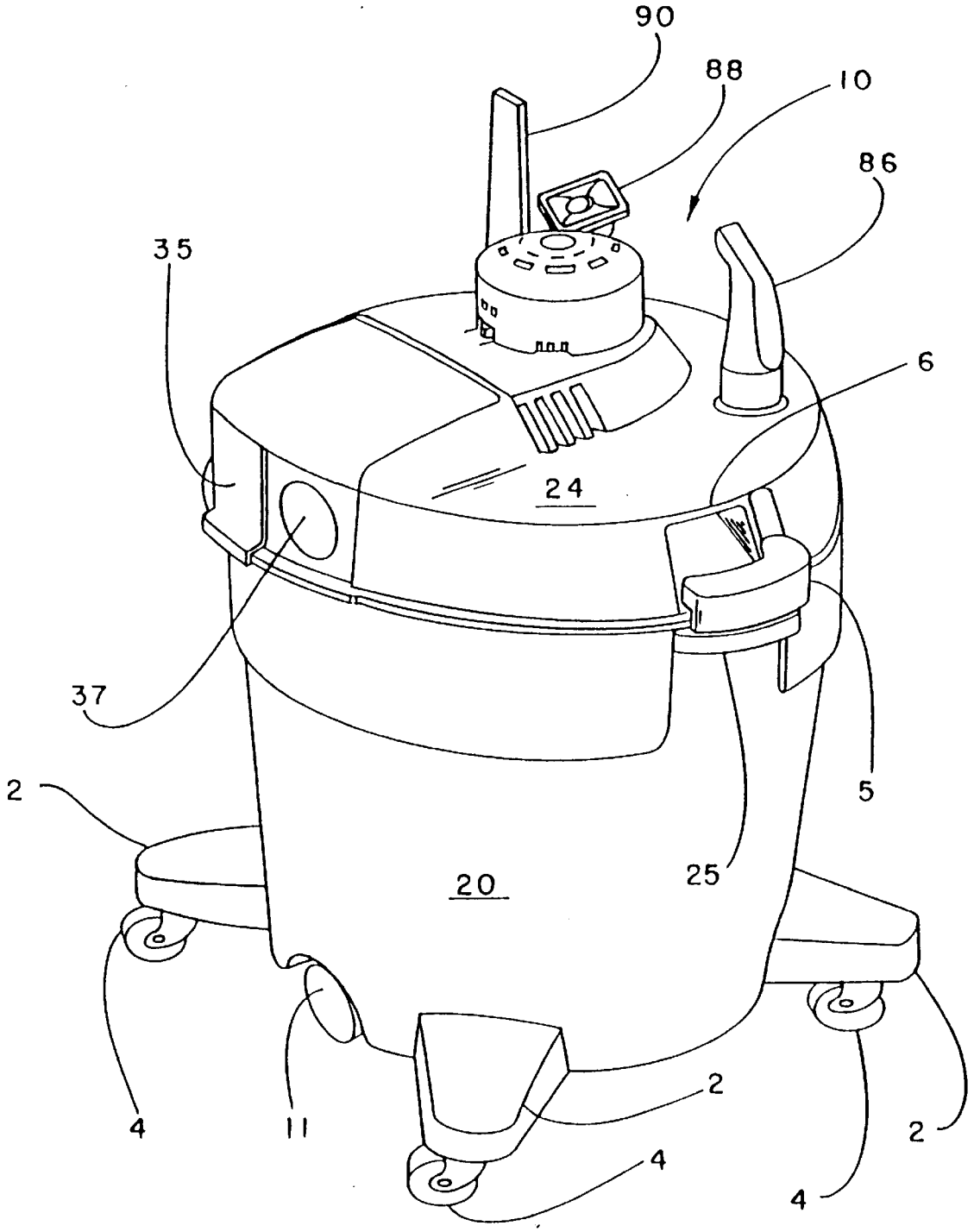
FIG. 1 is a perspective view of a tank type vacuum cleaner embodying the present invention.
Figure 3:
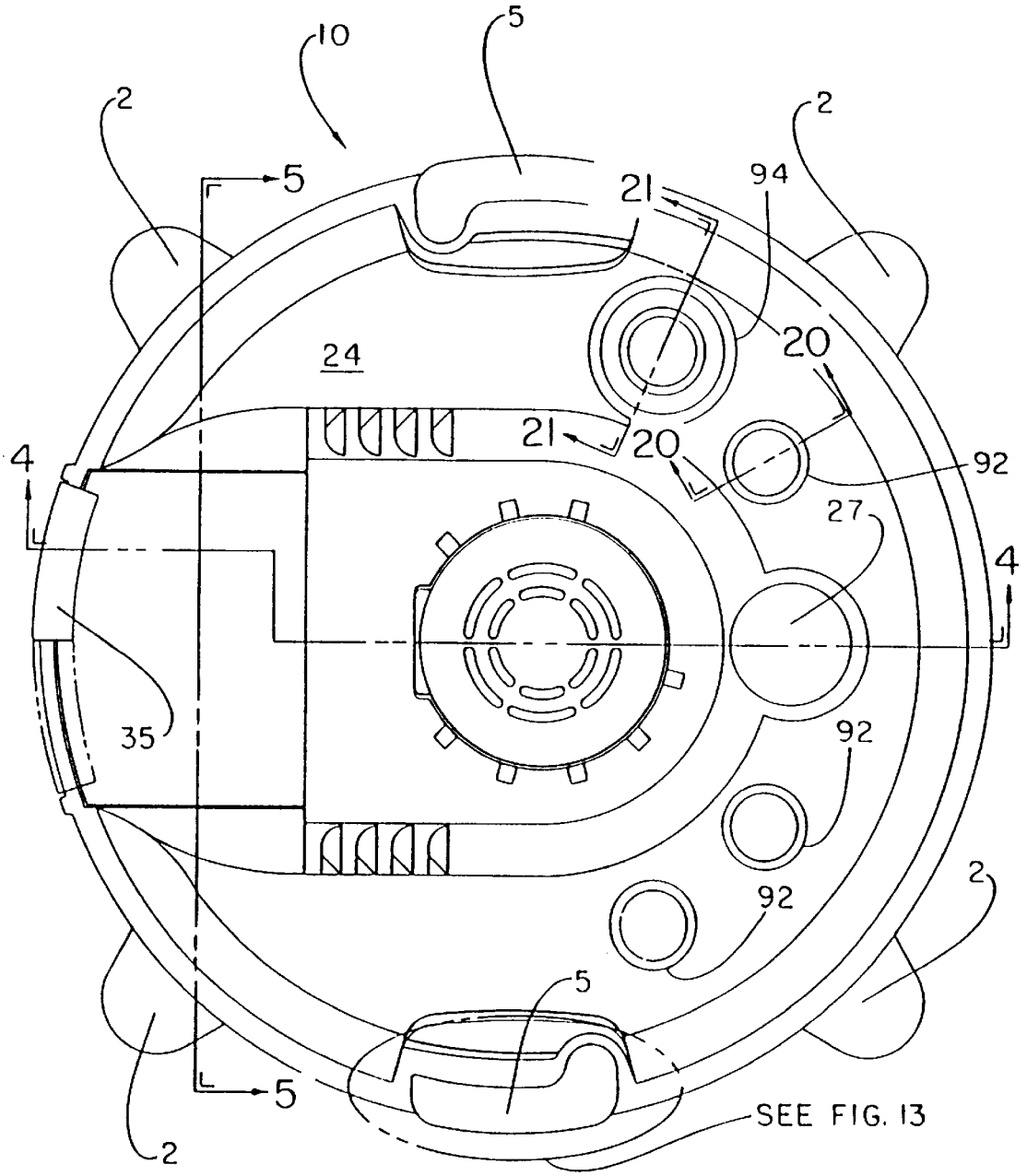
FIG. 3 is a top view of the tank type vacuum cleaner shown in FIG. 1 with vacuum accessories removed.

Referring to FIGS. 1 and 3, a wet/dry vacuum cleaner 10, of the utility tank type, is shown. Cleaner 10 typically comprises a bottom tank 20 and a power head or cover lid 24 removably and sealingly attached to bottom tank 20. Cover lid 24 is preferably affixed to tank 20 by two diametrically opposed latches 5. Tank 20 is typically supported upon four outrigger caster supports 2 having full swiveling casted wheels 4 attached thereto.

Figure 4:
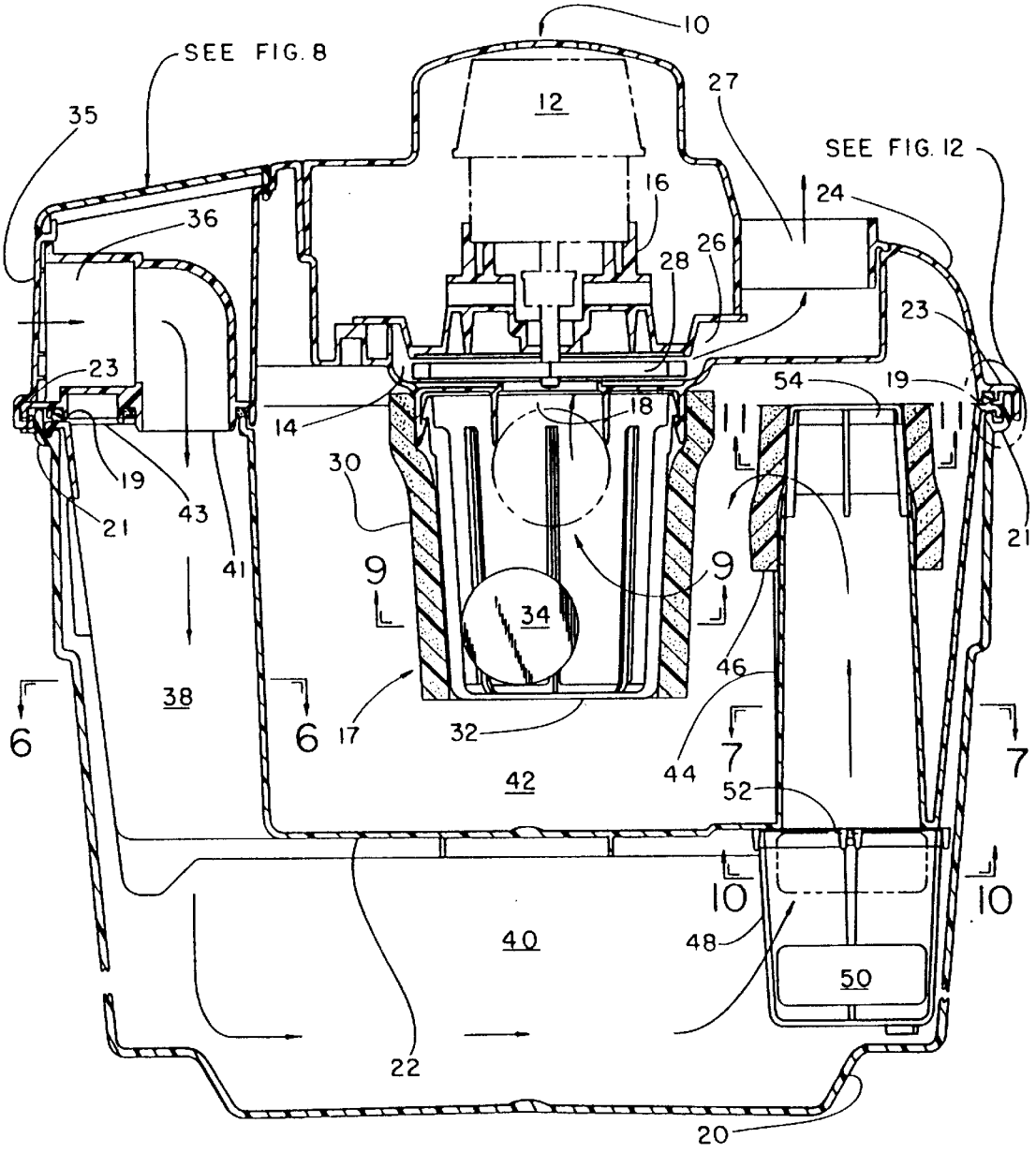
FIG. 4 is a cross-sectional view taken along line 4—4 of FIG. 3.
Figure 5:
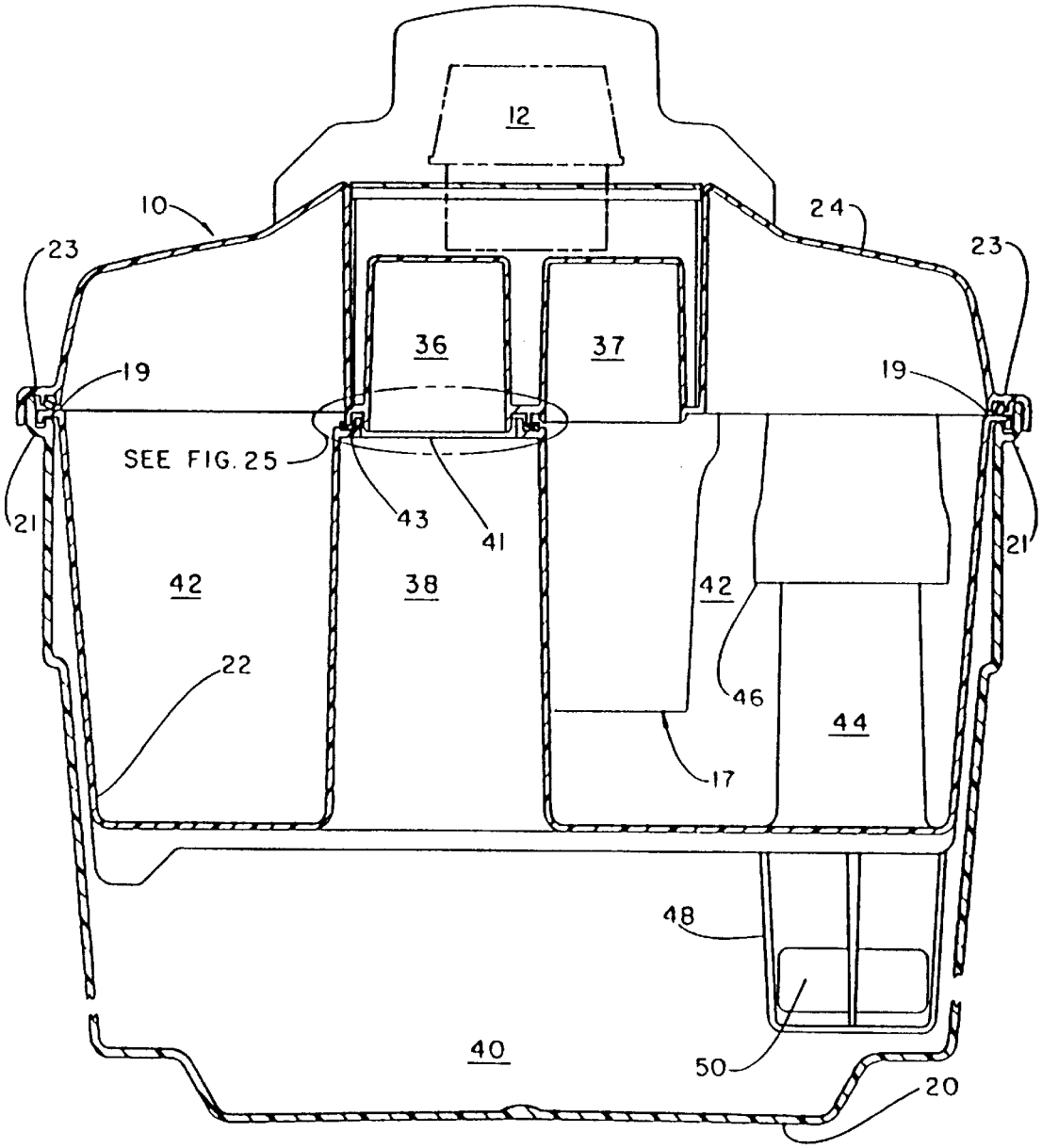
FIG. 5 is a cross-sectional view taken along line 5—5 of FIG. 3.
Figure 20:
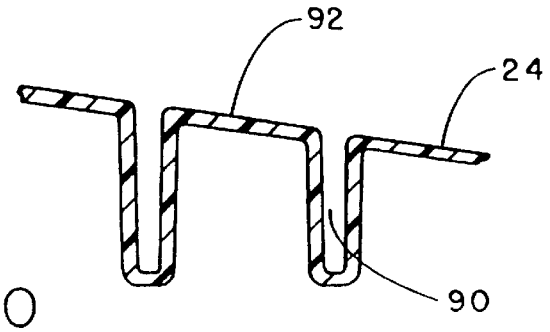
FIG. 20 is a cross-sectional view taken along line 20—20 of FIG. 3.
Figure 21:
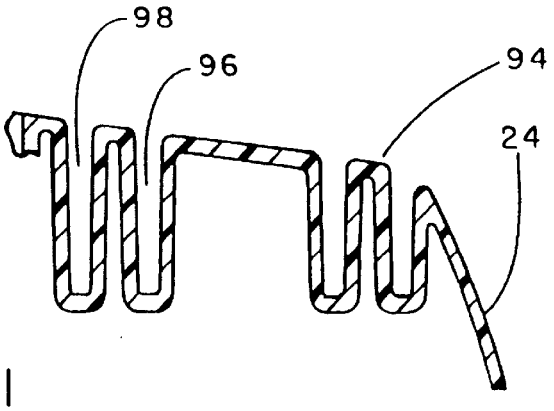
FIG. 21 is a cross-sectional view taken along line 21—21 of FIG. 3.
Figure 6:
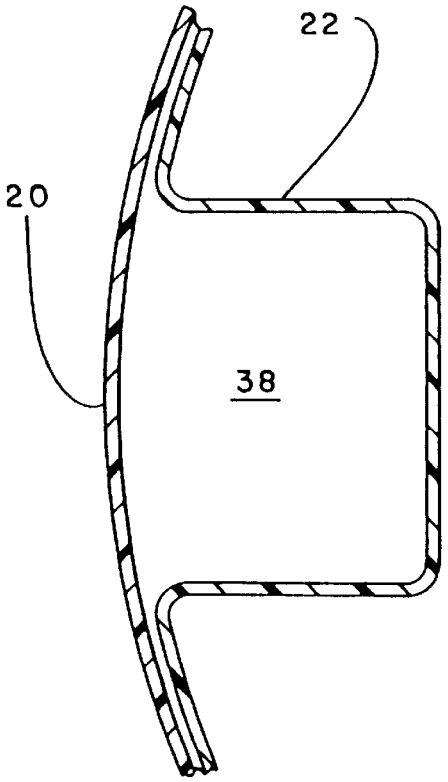
FIG. 6 is a cross-sectional view taken along line 6—6 of FIG. 4.
Figure 7:
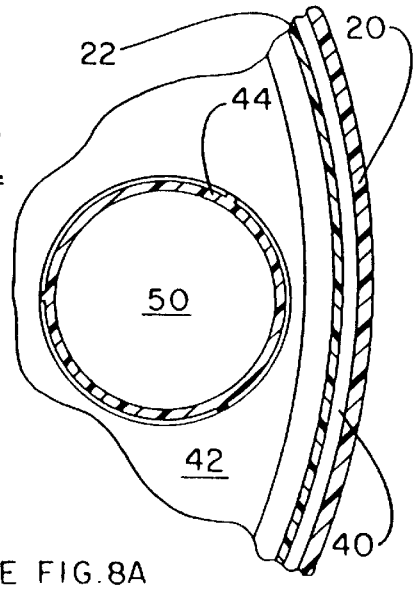
FIG. 7 is a cross-scctional view taken along line 7—7 of FIG. 4.
Figure 12:
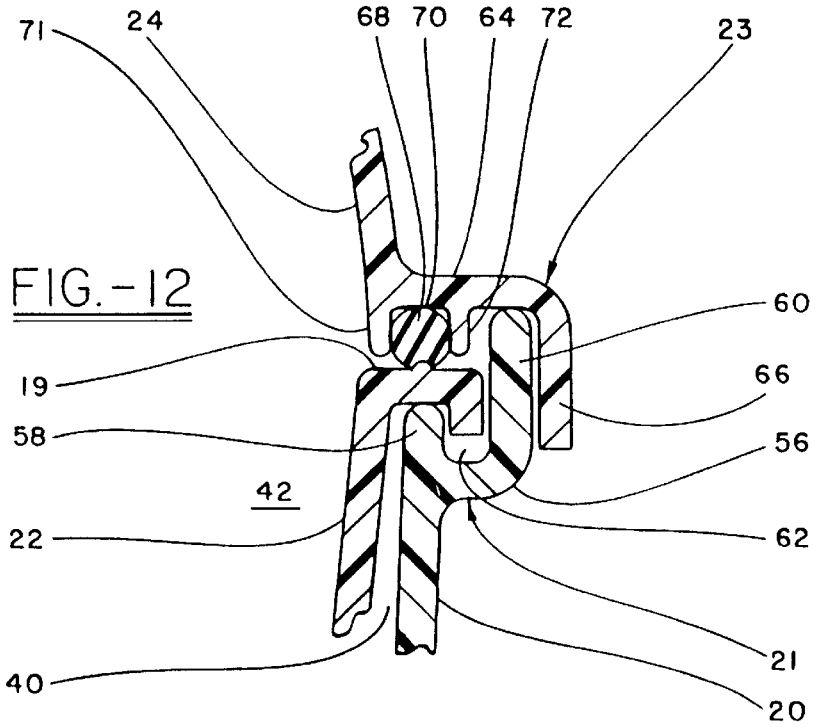
FIG. 12 is a partial and enlarged cross-sectional view showing the lid to tank seal as indicated in FIG. 4.

Referring further to FIGS. 4 and 5, telescopingly received within bottom tank 20 is inner tank 22 sealingly supported upon rim 21 of tank 20. Cover lid or power head 24 includes circumferential rim 23 which sealingly engages rim 19 of inner tank 22 and rim 21 of outer tank 20 as best illustrated in FIG. 12. The combination of bottom tank 20, inner tank 22 and lid 24 define two separate debris receiving chambers 40 and 42 within cleaner 10. Tank 22 is telescopingly received within tank 20 as seen in FIGS. 4 and 5. As can be readily observed the relative capacity of tank 40 with respect to tank 42 may be varied by extension or reduction of the respective tank side wall height. It is preferred that tank 20 receive and exclusively collect wet debris and vacuumed liquids; inner tank 22 is thereby intended for receipt of and exclusive collection therein of dry debris. The means for selectively directing wet and dry debris to tank 20 and 22 respectively is further discussed below.

Referring now to FIGS. 2, 4, 5, 6, and 7. Removable inner tank 22 incorporates a vertical inlet bypass 38 communicating with chamber 40 of wet tank 20, and exhaust tower 44 provides fluid communication between wet chamber 40 of tank 20 and dry chamber 42 of tank 22. Incorporated within cover 24 are two separate inlet ports 36 and 37. Inlet port 36 is intended for wet debris pickup and fluidly communicates directly with inlet bypass 38 thereby providing direct access to wet chamber 40 of tank 20. Inlet port 37, on the other hand, communicates direct with dry chamber 42 of dry tank 22.

Figure 25:
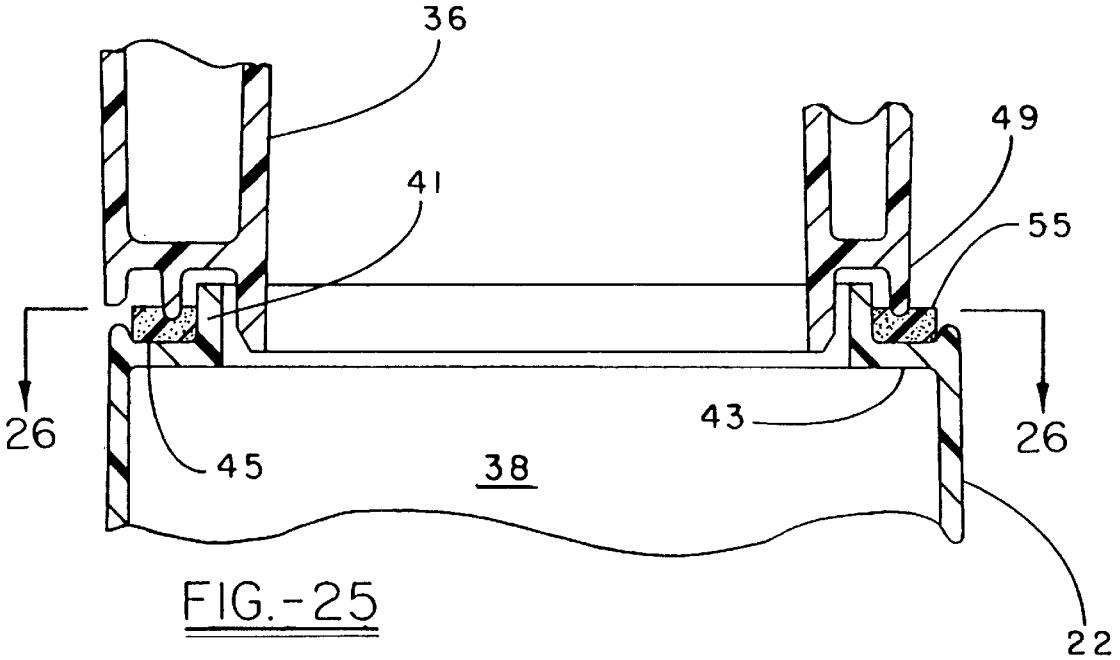
FIG. 25 is an enlarged cross-sectional view of the wet inlet port seal as indicated in FIG. 5.
Figure 26:
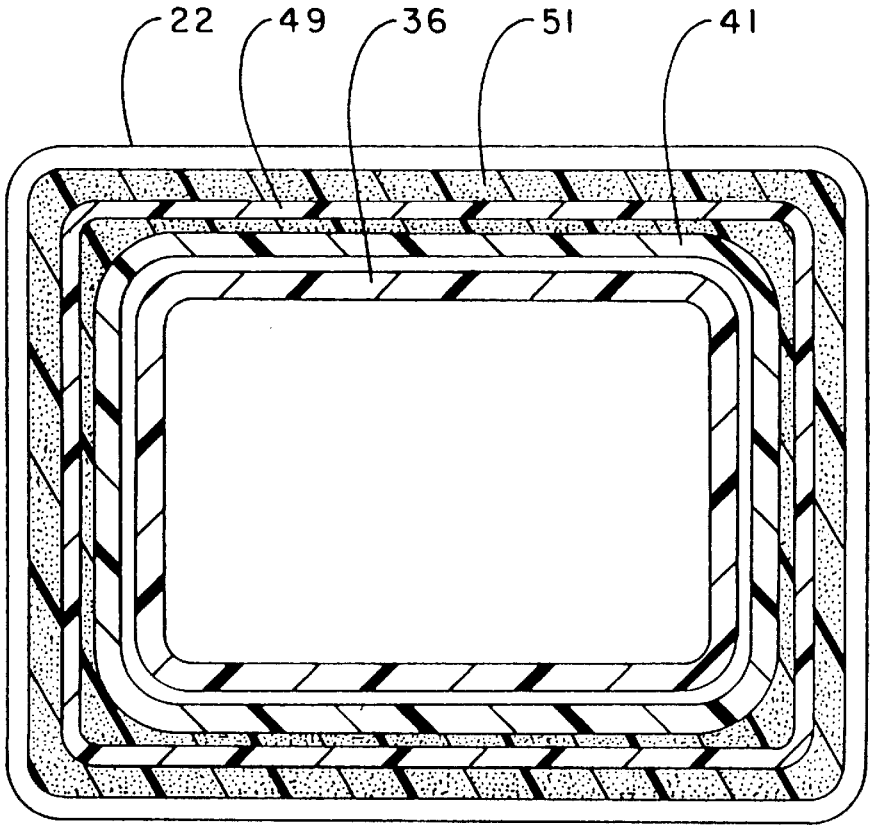
FIG. 26 is a cross-sectional view taken along line 26—26 of FIG. 25.

Wet inlet port 36 is sealingly received within rectangular aperture 41 of integrally molded top cover 43 of by-pass 38. As best seen in FIG. 25 and FIG. 26, aperture 41 is a circumscribed by a seal receiving groove 45 having positioned therein a suitable elastomeric seal 55. Inlet port 36 is provided a circumscribing downwardly extending scaling rib 49 that when top cover 24 is placed upon bottom tank 20, rib 49 sealingly engages seal 55 slightly compressing seal 55 between groove 45 and rib 49 thereby affecting an airtight seal between inlet port 36 and by-pass 38.

Figure 2:
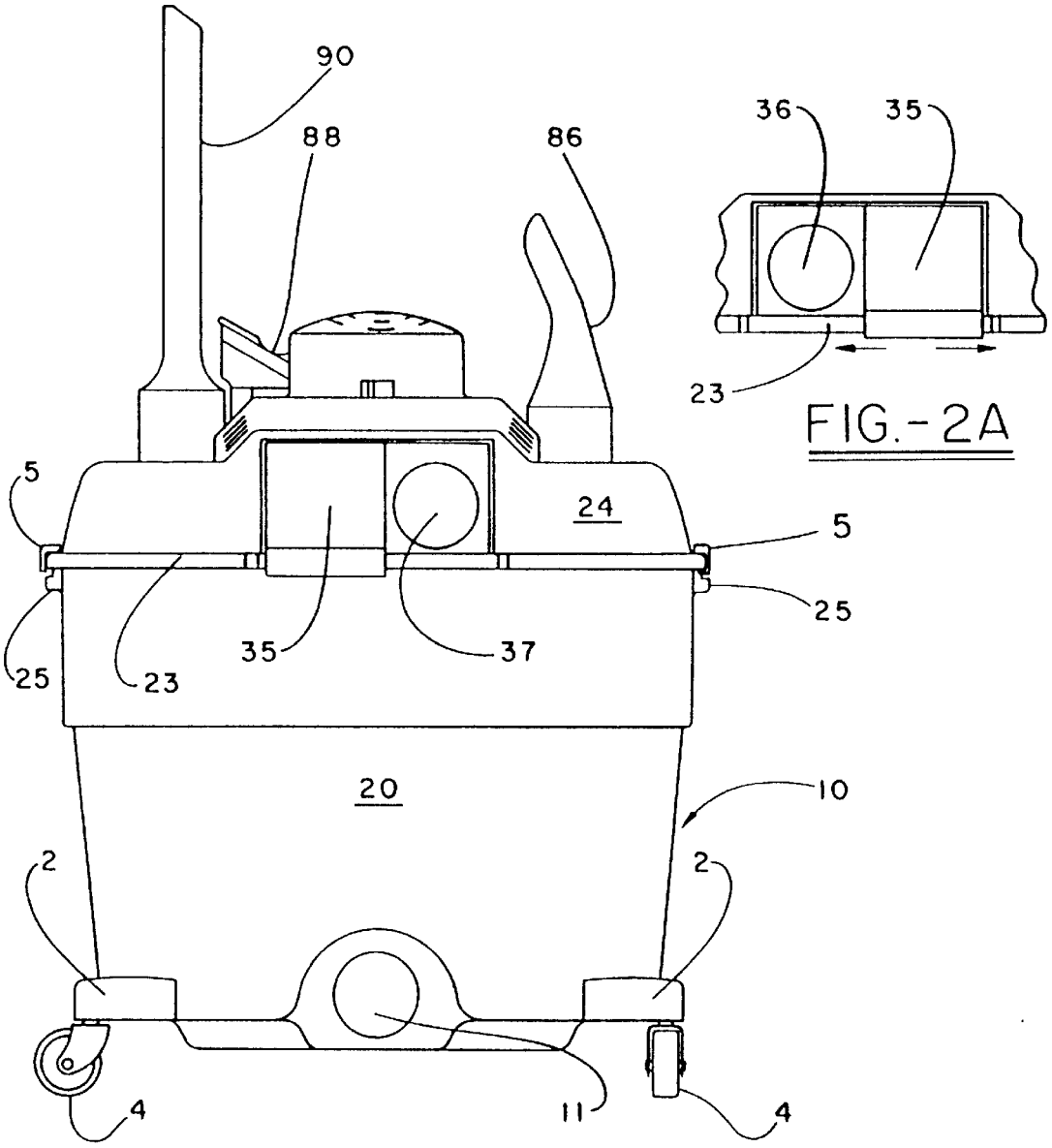
FIG. 2 is a front elevational view of the tank type vacuum cleaner shown in FIG. 1 with the valve door in the dry vacuuming mode.

Sliding valve door 35 freely translates left or right, as shown in FIG. 2 and 2A, thereby selectively sealing off inlet 36 or 37 as desired. When dry debris is being vacuumed, door 35 is positioned to the left, as seen in FIG. 2, and a suitable vacuum hose (not shown) is inserted into inlet port 37. Similarly when it is desired to vacuum wet debris, door 35 is positioned to the right, as shown in FIG. 2A, exposing wet inlet port 36 for vacuum hose insertion.

Figure 8A:
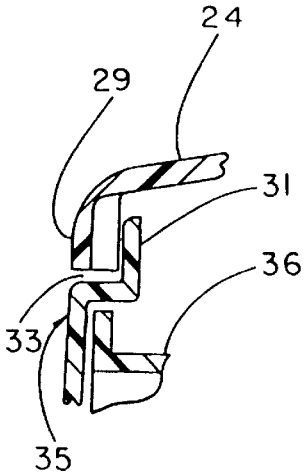
FIG. 8A is a partial and enlarged cross-sectional view showing the upper valve door attachment structure as indicated in FIG. 8.
Figure 8:
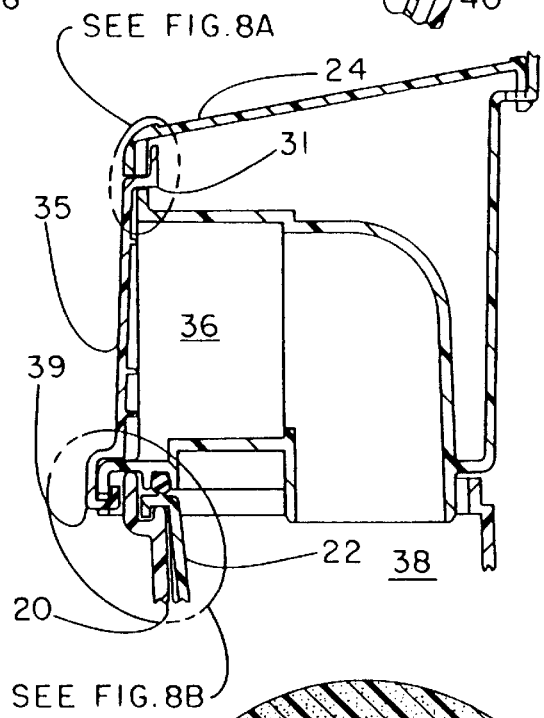
FIG. 8 is a partial and enlarged cross-sectional view showing the sliding valve door structure as indicated in FIG. 4.
Figure 8B:
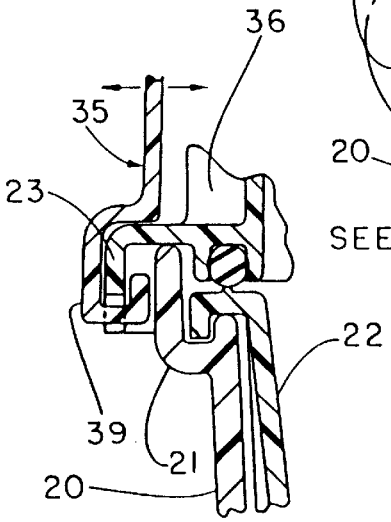
FIG. 8B is a partial and enlarged cross-sectional view showing the lower valve door attachment structure as indicated in FIG. 8.

Referring to FIGS. 8, 8A, and 8B the valving operation of valve door 35 will be described. Valve door 35, at the top thereof, is provided with an offset lip 31 extending through gap 33 between upper guide rail 29 of lid 24 and inlet port 36 and upward along the inside surface of guide rail 24 and inlet port 36 and upward along the inside surface of guide rail 29 as illustrated in FIG. 8A. Valve door 35 is further provided, at the bottom thereof an outwardly offset reverse bend or "J" hook 39 which engages the downturned rim or flange 23 of lid 24 as shown in FIG. 8B. It is to be noted that offset lip 31 and "J" hook 39 loosely engage guide rail 29 and rim 24, respectively, such that door 35 may move slightly inward and/or outward, as shown by the arrows in FIG. 8B, thereby permitting valve door 35 to be vacuum drawn against the selected inlet port 36 or 37 thus sealing off the selected port from the atmosphere and permitting vacuumed airflow exclusively through the open inlet port.

Figure 9:
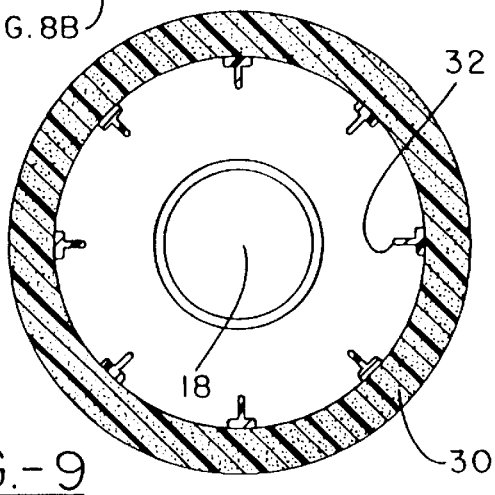
FIG. 9 is a cross-sectional view taken along line 9—9 of FIG. 4.
Figure 10:
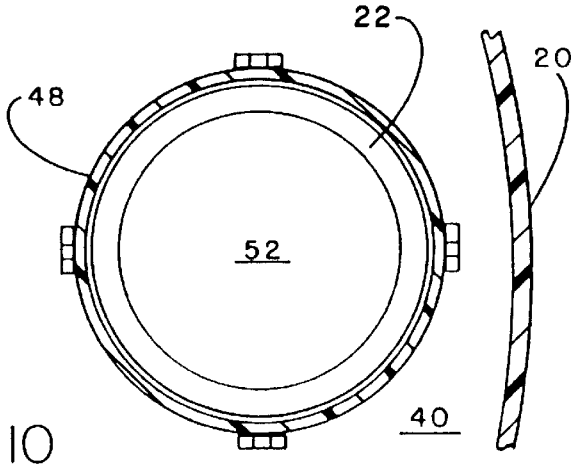
FIG. 10 is a cross-sectional view taken along line 10—10 of FIG. 4.
Figure 11:
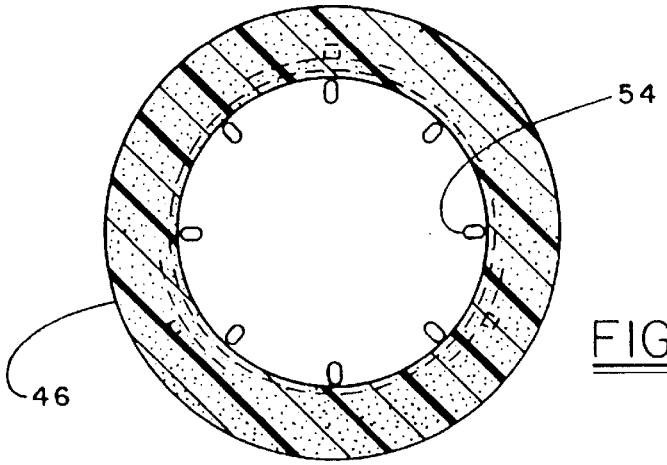
FIG. 11 is a cross-sectional view taken along line 11—11 of FIG. 4.

Referring again to FIG. 4, lid 24 has incorporated therein motor 12 supported upon suitable motor mounting structure 16. Motor mounting structure 16 in combination with lid 24 defines fan plenum chamber 14 having a centrifugal fan 28 therein. Fan plenum chamber 14 is provided with fan inlet eye 18 fluidly communicating with dry chamber 42 of inner tank 22 and fan exit 26 fluidly communicating with the cleaners exhaust port 27. Surrounding the fan eye 18 is a typical filter assembly 17 comprising a filter cage 32 suspended downward from lid 24 in any suitable manner and having a foam filter 30, or any other suitable filtering media, surrounding and cooperating with the filter cage 32 (FIG. 9) so that only filtered air is permitted to enter into fan eye 18. A typical spherical float 34 is confined within filter cage 32 to act as a check valve as described further below.

Referring now to FIGS. 4, 7, 10 and 11, the entrance 52 to tower 44 is protected by float valve 50 confined within a typical float cage 48. Float 50, having a density less than water, is intended to rise with the level of fluid collected in wet chamber 40, of outer tank 20, sealing off the entrance 52 of tower 44 when the volumetric capacity of fluid in tank 20 is reached, thereby , preventing further wet pickup until tank 20 is emptied via drain plug 11 (FIGS. 1 and 2). Atop tower 44 is filter cage 54 having a moisture absorbing filter 46 thereabout and cooperating with cage 54 such that all air exiting tower 44 into chamber 42 must pass through filter 46 whereby little or no moisture passes into dry chamber 42.

Having described above the basic structure of vacuum cleaner 10, we now may appreciate its operation by referring to FIGS. 2, 4, and 5. When the user desires to operate the cleaner 10 in the wet pickup mode, valve door 35 is slidingly moved to the right, as illustrated in FIG. 2A, thereby exposing wet inlet port 36. A vacuum hose, with the desired vacuum nozzle (not shown) is inserted into wet inlet port 36 and the motor fan 12, is electrically activated thereby creating a vacuum inside inner tank 22 and outer tank 20 via tower 44. The presence of a vacuum inside cleaner 10 thereby causes valve door 35 to be drawn against the dry inlet port 37, as described above, thereby effectively sealing off dry inlet port 37 from the atmosphere. Following the flow arrows in FIG. 4, moisture laden air enters wet inlet port 36 and is immediately directed downward through bypass 38 into the liquid collection chamber 40 between outer tank 20 and inner tank 22 wherein the water and wet debris is collected and retained. From wet chamber 40 the vacuumed air, minus the suspended moisture and wet debris, passes upward through tower 44, into the dry collection chamber 42 between inner tank 22 and cover 24 exiting therefrom through exhaust port 27 via the filter assembly 17, eye 18 and fan plenum chamber 14. Filter 46 atop tower 44 is preferably a moisture absorbing filter to absorb any remaining moisture in the airflow as it passes therethrough into dry chamber 42.

Tower 44 is empirically sized and proportioned to cause suspended liquid particles in the rising airflow to drop back into wet collection chamber 40.

Similarly when dry vacuuming is desired, valve door 35 is slidingly positioned to the left, as viewed in FIG. 2, thereby sealing off wet inlet port 36 from the atmosphere and exposing dry inlet port 37 for use. Dirt laden air enters the cleaner via dry inlet port 37 directly into dry collection chamber 42 of inner tank 22. Dry debris is thereby collected and retained within tank 22. After depositing its dry debris within inner tank 22, the working air passes through filter 30, into fan plenum 14 and exits the cleaner through exhaust port 27.

As is evident by the above description, vacuum cleaner 10 may be alternately used to pickup wet or dry debris without modification of the cleaner, except for selectively positioning valve door 35. In the event the operator desires to operate cleaner 10 exclusively for wet or exclusively for dry pickup and would like to have the maximum storage capacity of outer tank 20, inner tank 22 may be conveniently removed thereby making available the total capacity of outer tank 20. When the cleaner 10 is exclusively used for wet pickup, with inner tank 22 removed, the ball float check valve 34 of filter assembly 17 provides the function of float 50, by choking the airflow into fan eye 18 when the liquid level rises to its maximum desired level. In the event the user inadvertently uses dry inlet port 37 for wet pickup with inner tank 22 installed, ball check valve 34 also serves to close off fan eye 18 when the liquid capacity of inner tank 22 is reached.

FIG. 12 shows the preferred sealing arrangement between cover lid 24, inner tank 22 and outer tank 20. The peripheral rim 21 of tank 20 comprises an upward opening "U" shaped channel 56 having an inner leg 58 and an outer leg 60 defining a peripheral groove 62 therebetween. Resting upon inner peripheral leg 58 is radially extending flange 19 of inner tank 22. The surface to surface contact between inner leg 58 of outer tank rim 21 and the undersurface of flange 19 forms a first vacuum seal between wet chamber 40 of outer tank 20 and the atmosphere. Alternatively an elastomeric seal may be placed between leg 58 and the under surface of flange 19 or within peripheral groove 62 to assure a perfect seal therebetween. As seen in FIG. 12 outer leg 60 of outer tank rim 21 extends above inner leg 58 engaging the under surface of radially extending peripheral flange 64 of cover lid 24. Preferably flange 64 terminates with a turned down edge 66 which circumferentially overlaps leg 60 of outer tank rim 21 thereby cooperating with leg 60 to properly position lid 24 upon tank 20. The interface contact between leg 60 and the under surface of flange 64 also serves to provide a second vacuum seal between wet chamber 40 and the atmosphere. Positioned between the flange 64 of cover 24 and inner tank rim flange 19 is an elastomeric "O" ring seal 68. Preferably "O" ring seal 68 is retained within groove 70 by slightly compressing "O" ring seal 68 is retained within groove 70 by slightly compressing "O" ring 68 between groove legs 71 and 72. Thus chamber 42 between lid 24 and inner tank 22 is positively sealed off from wet chamber 40 of outer tank 20 and the atmosphere.

The "O" ring seal 68 between cover lid 24 and inner tank 22 is preferred to positively assure that no moisture, from wet chamber 40 of outer tank 20 will leak past the surface to surface seal provided by leg 58 of rim 21 and flange 19 of inner tank 22.

Figure 17:
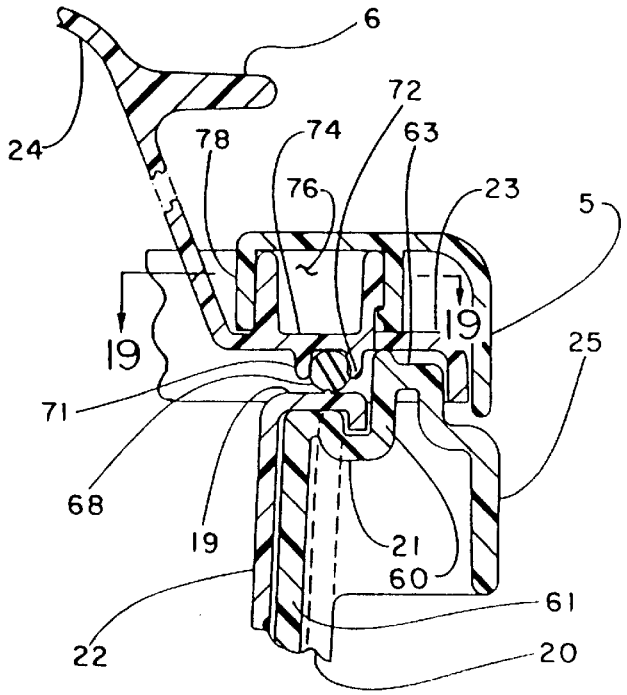
FIG. 17 is a cross-sectional view taken along line 17—17 of FIG. 13.

In the vicinity of outer tank hand holds 25 (see FIGS. 1, 2 and 17) the rim 21 of outer tank 20 and rim 19 of inner tank 22 are modified as shown in FIG. 17 to accommodate hand hold 25 and incorporate the lid to tank latch 5. To provide a lifting hand hold 25 on outer tank 20, tank wall 61 is slightly recessed, as shown in FIG. 17, and a radially extending projection 63 extends from outer leg 60 of outer tank rim 21 terminating with the downwardly extending hand hold 25. Aligned with hand hold 25 of outer tank 20, are lift handles, 6, for removing cover 24, molded into the upper profile of lid 24 thereby providing an extended flange surface 74 upon which hollow cylindrical post 76 is integrally molded to rotatingly receive thereon arcuate latch lever 5.

Figure 18:
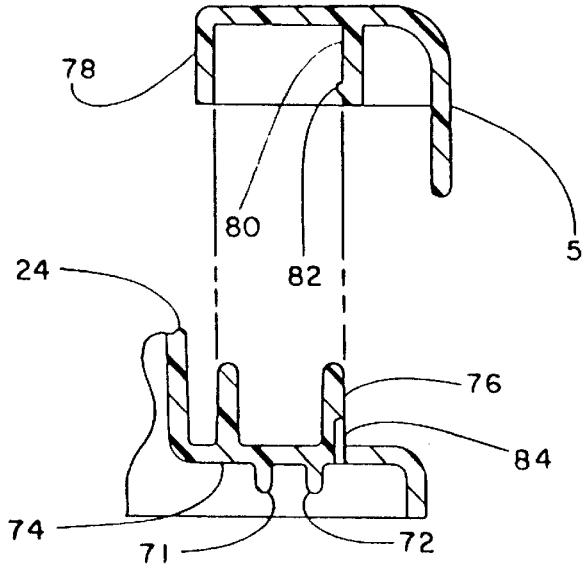
FIG. 18 is a cross-sectional view, similar to FIG. 17, showing the latch arm removed from the latch post.
Figure 19:
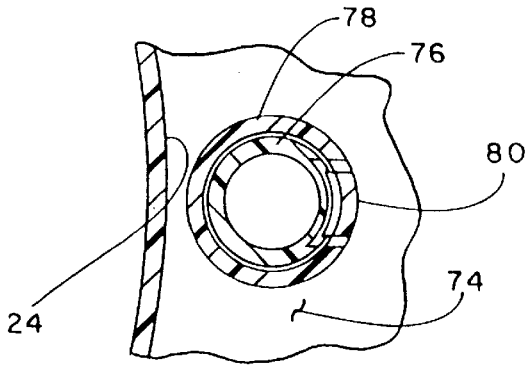
FIG. 19 is a cross-sectional view taken along line 19—19 of FIG. 17.

Referring now to FIGS. 13 through 19, the latching lever assembly and means by which lid 24 is secured to tank 20 will be described. As illustrated in FIGS. 18 and 19 arcuate latch lever 5 includes a hollow cylindrical pivot 78 which telescopingly receives therein hollow post 76. A cylindrical portion of hollow pivot 78 comprises a cantilevered spring 80 having a inwardly directed tab 82 at the free and thereof. Latching lever 5 is attached to hollow post 76 by sliding hollow pivot 78 downward over hollow post 76 until tab 82 snaps into the complimentary circular groove 84 on hollow post 76 thereby locking latch lever 5 upon hollow post 76. Circular groove 84 extends throughout an included angle sufficient to provide the necessary angular movement of latch lever 5 about post 76 to provide latching and unlatching of lid 24 to outer tank 20.

Figure 13:
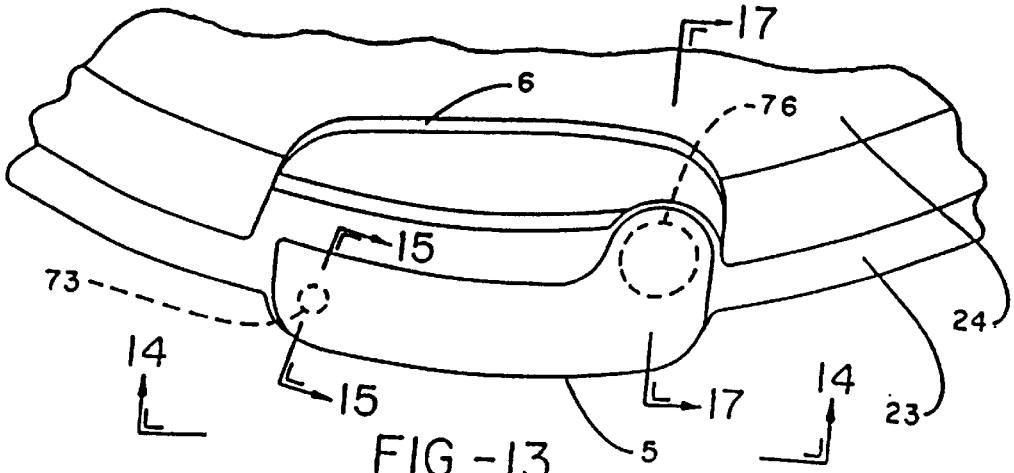
FIG. 13 is a partial and enlarged top view of the lid to tank latch as indicated in FIG. 3.
Figure 14:
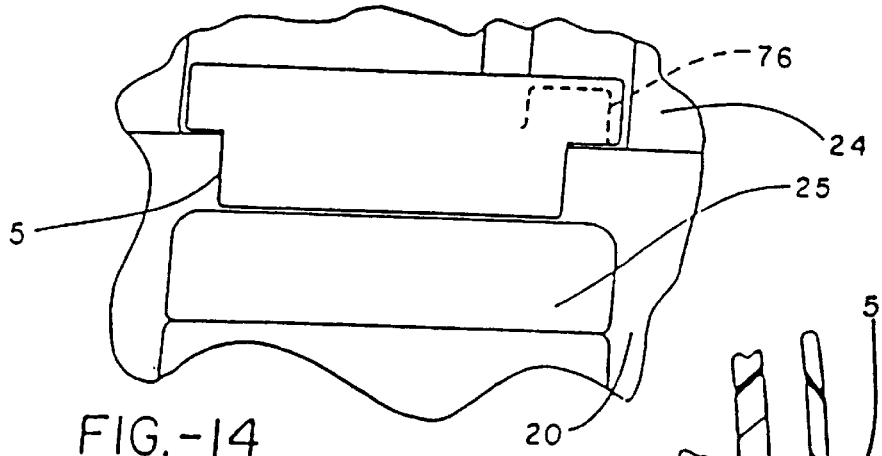
FIG. 14 is a partial elevational view taken long line 14—14 of FIG. 13 showing the vacuum cleaner lid latch.
Figure 15:
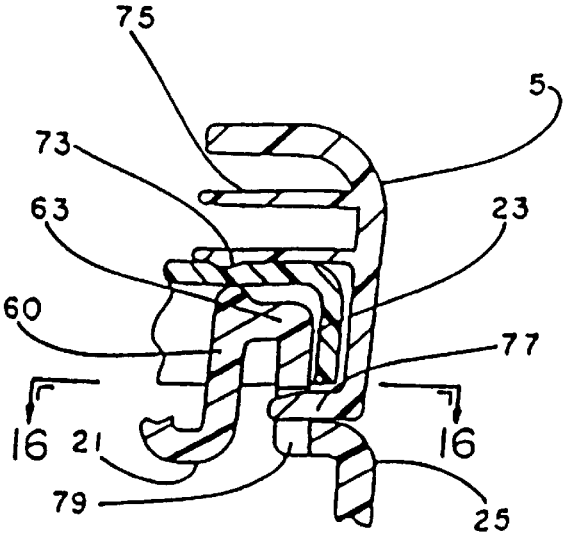
FIG. 15 is a cross-sectional view taken along line 15—15 of FIG. 13.
Figure 16:
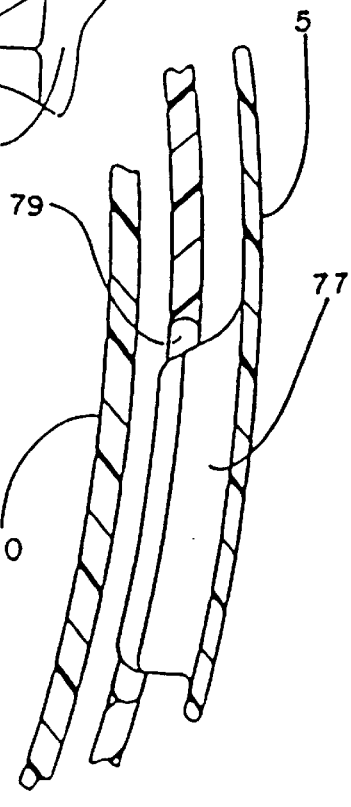
FIG. 16 is a cross-sectional view taken along line 16—16 of FIG. 15.

Latch lever 5 generally follows the peripheral curvature of rim 23 as illustrated in FIG. 13 and includes a radial inwardly extending shoulder 75 and parallel latching tang 77. When in the closed or latched position, as illustrated in FIGS. 13, 17, and 15, shoulder 75 of latch 5 frictionally engages the top horizontal surface of rim 23 and latching tang 77 is received within slot 86 of handle 25 thereby compressing therebetween rim 23 and the radial projection 63 of outer tank rim 21. Thus a vertical clamping force is applied between outer tank rim projection 63 and the underside surface of power head rim 23. Further "O" ring 68 is drawn down upon inner tank rim 19 thereby urging inner tank rim 19 against the rim 21 of outer tank 20. To remove power head 24, arcuate latch 5 is rotated outwardly from the cleaner thereby disengaging shoulder from 75 from power head rim 23 and latching tang 77 from slot 79.

To prevent the inadvertent opening of latch 5 when subjected to the normal motor vibration during operation of the cleaner, shoulder 75 of latch lever 5 and rim 23 of power head 24 are preferably provided with an interlocking detent 73 which resists vibrational opening but permits manual disengagement.

As seen in FIGS. 1 through 3 and 20 and 21, the lid or cover is preferably provided with integrally molded vacuum tool accessory storage posts 92 and 94. Storage post 92 comprises a recessed cylindrical groove 90 defining a coaxial post 92 having a diameter approximately sized to frictionally receive thereupon a vacuum accessory tool such as nozzles 88 and 86 as illustrated in FIGS. 1 and 2.

Accessory storage post 94 comprises two recessed, concentric cylindrical grooves 96 and 98 thereby providing frictional storage posts for two different sized vacuum accessories.

Figure 23:
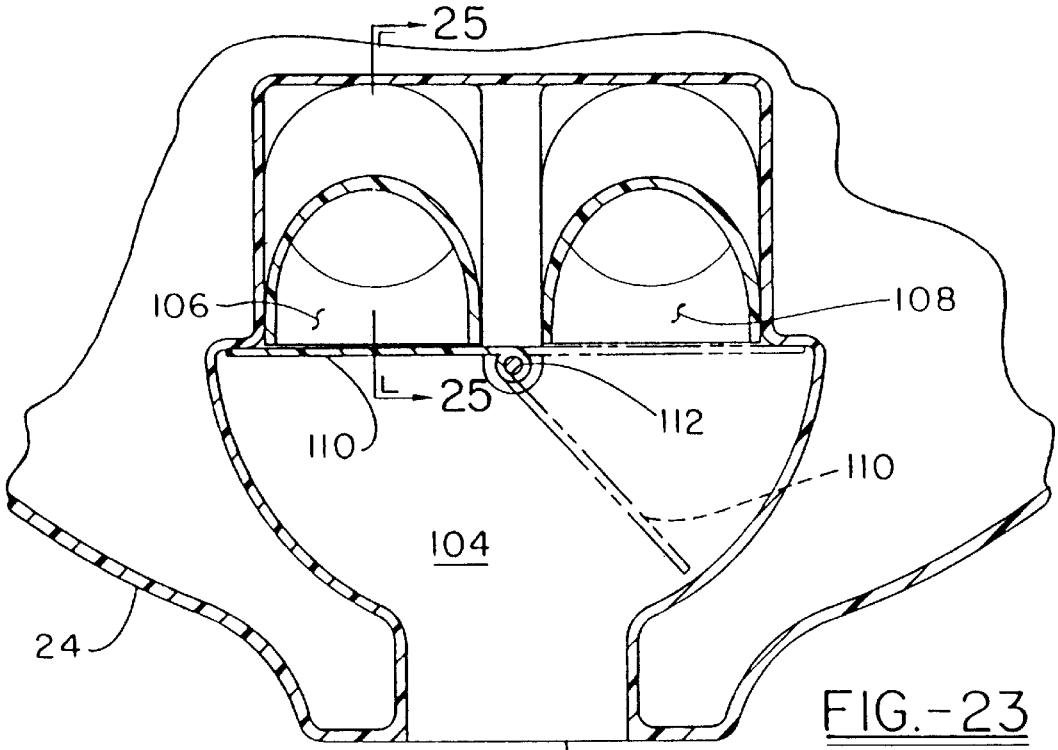
FIG. 23 is a cross-sectional view taken along line 23—23 of FIG. 22 showing an alternate valve door structure for use with the single vacuum inlet port as shown in FIG. 22.
Figure 22:
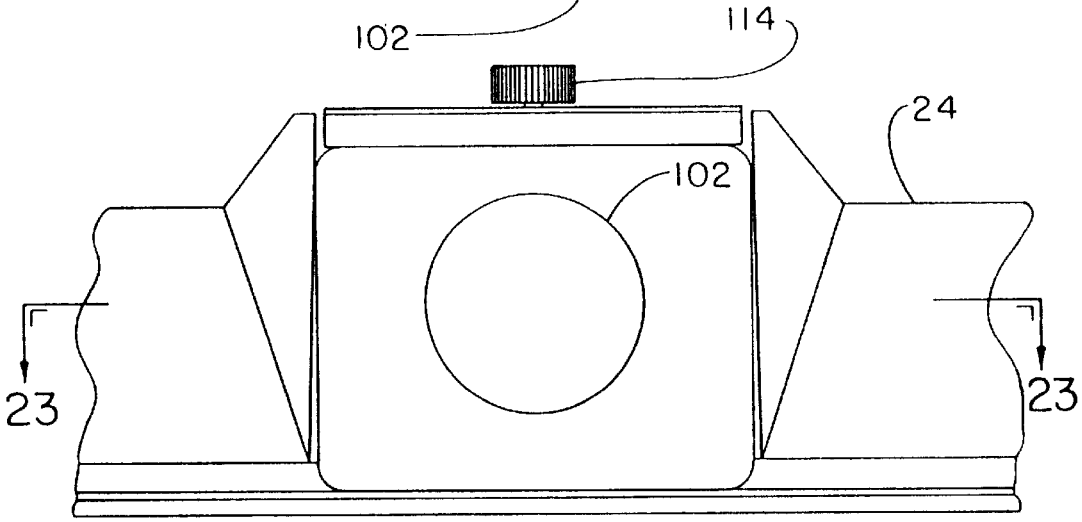
FIG. 22 is a partial front elevational view showing a single inlet vacuum port as an alternate embodiment.
Figure 24:
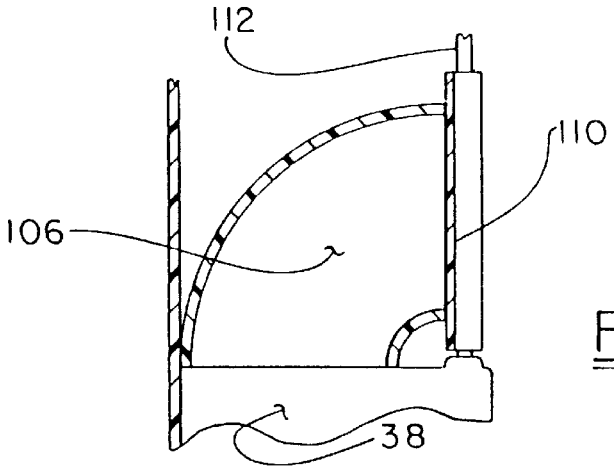
FIG. 24 is a cross-sectional view taken along line 24—24 of FIG. 23.

FIGS. 22 through 24 generally show an alternate embodiment wherein a single inlet port 102 is provided for insertion of a vacuum hose (not shown) thereby eliminating the need for the user to physically move the vacuum hose between the wet and dry inlet ports as is necessary in the above described preferred embodiment. Inlet port 102 fluidly communicates with manifold 104 which in turn has wet and dry inlet ports 106 and 108 function as inlet ports 36 and 37, respectively, as discussed above. Valve door 110 rotates about pivot shaft 112 by hand operation of knob 114 by the user to selectively choose wet or dry operation. When dry material is to be vacuumed, the operator rotates knob 114 clockwise thereby causing valve door 110 to close off wet inlet port 106 from manifold 104 and open dry inlet port 108 so as to receive dry debris entering manifold 104 via inlet port 102. Similarly when the operator desires to vacuum wet debris, wet inlet port 106 is opened and dry inlet port 108 is closed off and sealed from manifold 104 by rotating knob 114 counterclockwise. Wet and dry inlet ports 106 and 108 are configured within power head 24 to replace inlet ports 36 and 37 so as to fluidly communicate with wet bypass 38 and inner tank 22 (as shown in FIG. 5).

FIGS. 27 and 28 generally show another alternative embodiment wherein a single inlet port 202 is provided for insertion of a vacuum hose 204 thereby eliminating the need for the user to physically move the vacuum hose 204 between the wet and dry inlet ports as is necessary in the above-described preferred embodiment. Inlet port 202 fluidly communicates with a plenum 206 which in turn fluidly communicates with an outlet port 208 that may be selectively positioned between the wet and dry tanks. The plenum 206 is formed in an elbow-shaped body member 210 that is rotatably carried by the lid 24.

When dry material is to be vacuumed, the operator rotates the body 210 clockwise thereby causing outlet port 208 to communicate with the dry inlet port 37. Similarly, when the operator desires to vacuum wet debris, the user rotates the body 210 counterclockwise until the outlet port 208 fluidly communicates with the wet bypass 38. Thus, it can be seen that the rotating body 210 having the single plenum 206 is received within the lid 24 to replace the inlet ports 36 and 37.

Of course, specific location of the wet and dry tanks may vary in other embodiments of the invention. In such situations, the direction of rotation of the body member 210 may be reversed such that it is rotated counterclockwise to communicate with the dry tank and clockwise to communicate with the wet tank. The body member 210 may be supported by the lid 24 by any one of the many configurations known in the art. In FIG. 27, the body member 210 is depicted as having a channel 214 that cooperates with the lid 24 to rotatably carry the body member 210.

The invention also contemplates that a member may be provided that actuates the movement of the body member. This member may also be any of those members known in the art. Accordingly, the member may simply be the extended portion 212 of the inlet end of the body member 210 that extends outwardly from the lid 24. When this configuration is used, the user grasps the extended portion 212 and rotates the body member 210 in the appropriate direction.

Although the invention has been described in detail with reference to the illustrated preferred embodiment, variations and modifications exist within the scope and spirit of the invention as described and as defined in the following claims.

Thus it should be evident that the device and methods of the present invention are highly effective for use in a two tank utility vacuum. The invention is particularly suited for such a two tank utility vacuum, but is not necessarily limited thereto. The device and method of the present invention can be used separately with other equipment, methods and the like Based upon the foregoing disclosure, it should now be apparent that the use of the valves for a two tank utility vacuum described herein will carry out the objects set forth hereinabove. It is, therefore, to be understood that any variations evident fall within the scope of the claimed invention and thus, the selection of specific component elements can be determined without departing from the spirit of the invention herein disclosed and described. Thus, the scope of the invention shall include all modifications and variations that may fall within the scope of the attached claims.

What is claimed is:

1. A valve in a utility vacuum cleaner having a main body defining therein first and second debris collecting receptacles, the valve selectively directing debris laden air to said first or second receptacle, said valve comprising:

a body member defining a plenum, said plenum having an inlet port and an outlet port;

said body member rotatable between a first position and a second position;

said outlet port of said plenum in fluid communication with the first debris collecting receptacle when said body member is in said first position and said outlet port of said plenum is in fluid communication with the second debris collecting receptacle when said body member is in said second position.

2. A valve according to claim 1, wherein the vacuum cleaner includes a main body and a lid engaging the main body, said body member rotatably carried by the lid.

3. A valve according to claim 2, wherein said body member includes a portion that extends outwardly from the lid.

4. A valve according to claim 1, wherein said inlet port is configured to accept the insertion of a vacuum hose.

5. A valve according to claim 1, further comprising means for rotating said body member between said first position and said second position.

6. A valve according to claim 1, wherein one of the first and second debris collecting receptacles is telescopingly received within the other debris collecting receptacle.

7. A valve according to claim 6, wherein one of the first and second debris collecting receptacles has a dry inlet port and the other of the first and second debris collecting receptacles has a wet bypass, said plenum being in fluid communication with said dry inlet port when said body member is in said first position and said plenum being in fluid communication with said wet bypass when said body member is in said second position.

8. A valve according to claim 1, further comprising a lid that engages the main body, said lid supporting a motor/fan assembly that is operable to create a working air flow, said valve carried by said lid.

9. A valve according to claim 8, wherein said body member extends outwardly from said lid.

10. A valve according to claim 8, wherein said plenum is in fluid communication with said working air flow when said body member is in said first and second positions.

11. A valve according to claim 10, wherein said working air flow passes through both of the debris collecting receptacles when said body member is in said second position.

12. In a utility vacuum cleaner having a main body, first and second debris collecting receptacles, and a lid engaging the main body and supporting a motor/fan assembly that is capable of creating a working air flow, the improvement comprising a valve that selectively directs the working air flow through the first and second debris collecting receptacles, said valve having a first position and a second position, the working air flow passing through both of the debris collecting receptacles when said valve is in said first position and the working air flow passing through only one of the debris collecting receptacles when said valve is in said second position.

13. The vacuum cleaner as claimed in claim 12 further comprising a check valve between the motor/fan assembly and one of the debris collecting receptacles.

14. The vacuum cleaner as claimed in claim 12 further comprising a check valve between the debris collecting receptacles.

* * * * *